US009893451B2

(12) United States Patent
Zhang et al.

(10) Patent No.: US 9,893,451 B2
(45) Date of Patent: Feb. 13, 2018

(54) PLUG CONNECTOR HAVING A TERMINAL PROTECTOR

(71) Applicant: FOXCONN INTERCONNECT TECHNOLOGY LIMITED, Grand Cayman (KY)

(72) Inventors: Cheng Zhang, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/597,502

(22) Filed: May 17, 2017

(65) Prior Publication Data

US 2017/0338578 A1 Nov. 23, 2017

(30) Foreign Application Priority Data

May 17, 2016 (CN) ..... 2016 1 0324772

(51) Int. Cl.

| | |
|---|---|
| ***H01R 11/30*** | (2006.01) |
| ***H01R 13/24*** | (2006.01) |
| ***H01R 13/516*** | (2006.01) |
| ***H01R 13/62*** | (2006.01) |

(52) U.S. Cl.

CPC ..... *H01R 13/2421* (2013.01); *H01R 13/516* (2013.01); *H01R 13/6205* (2013.01)

(58) Field of Classification Search

CPC ..... H01R 13/516; H01R 13/6205; H01R 13/2421

USPC ..... 439/39, 587, 88, 118, 259

See application file for complete search history.

(56) References Cited

U.S. PATENT DOCUMENTS

| | | | | |
|---|---|---|---|---|
| 7,217,142 | B1 * | 5/2007 | Wu | H01R 13/5804 439/607.41 |
| 8,337,256 | B1 * | 12/2012 | Lin | 439/700 |
| 8,651,900 | B1 * | 2/2014 | Hsu | H01R 12/714 439/700 |
| 9,419,376 | B1 * | 8/2016 | Blum | H01R 13/6205 |

(Continued)

FOREIGN PATENT DOCUMENTS

| | | |
|---|---|---|
| CN | 105098512 | 11/2015 |

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

A plug connector (100) includes: a sleeve (1) having a receiving cavity (11); and a terminal module (10) including a fixed body (7) received in the receiving cavity (11), an insulative housing (11) located in front of the fixed body (7) and extended beyond the sleeve (1), a magnetic element (6) received in the sleeve (1), a plurality of movable terminals (4), and plural elastic elements (5), the insulative housing (11) having a number of through holes (31), the other end of the elastic element (5) bearing against the fixed body (7), the movable terminals (4) in non-retracted state being located inwardly of the insulative housing (3), the insulative housing (3) being operable to move backwards urging against the elastic elements (5) and exposing the movable terminals (4) in retracted state out of the insulative housing (3); wherein the movable terminals (4) are sheathed in the elastic elements (5).

9 Claims, 7 Drawing Sheets

(56) References Cited

U.S. PATENT DOCUMENTS

2008/0003841 A1* 1/2008 Su ..... H01R 13/44 439/55
2008/0280495 A1* 11/2008 Ko ..... H01R 43/0256 439/638
2009/0117783 A1* 5/2009 Wu ..... H01R 13/2435 439/660
2010/0120290 A1* 5/2010 Ko ..... H01R 13/502 439/626
2011/0092081 A1* 4/2011 Gao ..... H01R 9/03 439/40
2012/0028489 A1* 2/2012 Gramsamer ..... H01R 13/2421 439/271
2012/0184114 A1* 7/2012 Li ..... H01R 13/6205 439/38
2013/0084718 A1* 4/2013 Kobayashi ..... H01R 13/2442 439/81
2013/0328484 A1* 12/2013 Villarreal ..... H01R 13/2421 315/127
2014/0113461 A1* 4/2014 Kim ..... H01R 13/6205 439/39
2014/0199895 A1* 7/2014 Chui ..... G01R 1/06722 439/824
2014/0256163 A1* 9/2014 Kuo ..... H01R 13/6205 439/39
2014/0263908 A1* 9/2014 Franklin ..... F16M 13/02 248/309.4
2014/0273546 A1* 9/2014 Harmon ..... H01R 13/6205 439/39
2015/0017831 A1* 1/2015 Wang ..... H01R 13/6683 439/488
2015/0092324 A1* 4/2015 Shah ..... H01R 13/2407 361/679.01
2015/0118868 A1* 4/2015 Choi ..... H01R 11/30 439/39
2015/0171531 A1* 6/2015 Rathi ..... H05K 3/32 361/769
2015/0188253 A1* 7/2015 Tada ..... H01R 13/6205 439/39
2015/0280343 A1* 10/2015 Hsu ..... H01R 13/2421 439/607.01
2015/0288091 A1* 10/2015 Wang ..... H01R 12/714 439/587
2015/0311619 A1* 10/2015 Kato ..... H01R 13/6594 439/137
2015/0325939 A1* 11/2015 Kim ..... B23K 33/002 439/700
2015/0333432 A1* 11/2015 Wu ..... H01R 13/46 439/39
2015/0333440 A1* 11/2015 Zhu ..... H01R 13/6205 439/39
2015/0333448 A1* 11/2015 Wu ..... H01R 13/6205 439/39
2016/0006187 A1* 1/2016 Kim ..... H01R 13/7038 439/39
2016/0064854 A1* 3/2016 Schooley ..... H01R 13/2421 439/39
2017/0062974 A1* 3/2017 Daoura ..... H01R 13/6205
2017/0093071 A1* 3/2017 DiFonzo ..... H01R 13/2421

* cited by examiner

PLUG CONNECTOR HAVING A TERMINAL PROTECTOR

BACKGROUND OF THE INVENTION

1. Field of the Invention

The present disclosure relates to a plug connector having a movable terminal protector and associated elastic elements.

2. Description of Related Arts

U.S. Patent Application Publication No. 2015/0333432, published on Nov. 19, 2015, discloses a plug connector comprising a magnetic element having a cavity; a contact protector movably accommodated in the cavity, the protector defining a front end and a plurality of slots through the front end; a plurality of retractable, e.g., POGO-type, contacts accommodated in the slots, each contact having a front end located in the front end of the contact protector; and an elastic element urging the contact protector to extend the front end thereof out of the cavity. The elastic element is arranged on both sides of the plurality of contacts such that the dimension of the accommodating cavity is increased.

An improved plug connector is desired.

SUMMARY OF THE INVENTION

Accordingly, an object of the present invention is to provide a plug connector of a reduced size.

To achieve the above object, a plug connector comprises: a sleeve having a receiving cavity; and a terminal module including a fixed body received in the receiving cavity, an insulative housing located in front of the fixed body and extended beyond the sleeve, a magnetic element received in the sleeve, a plurality of movable terminals, and a plurality of elastic elements, the insulative housing having a plurality of through holes, one end of the movable terminal being received in a corresponding through hole, the other end of the movable terminal being fixed on the fixed body, one end of the elastic element bearing against the insulative housing, the other end of the elastic element bearing against the fixed body, the movable terminals in non-retracted state being located inwardly of the insulative housing, the insulative housing being operable to move backwards urging against the elastic elements and exposing the movable terminals in retracted state out of the insulative housing; wherein the movable terminals are sheathed in the elastic elements.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
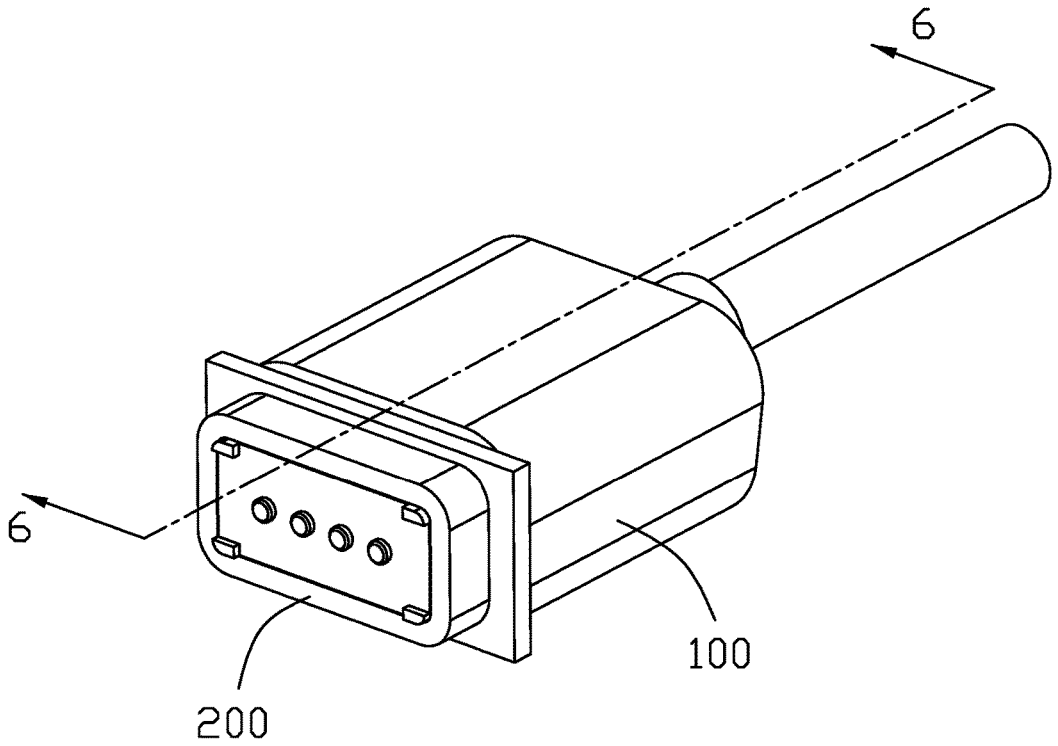
FIG. 1 is a perspective view of a plug connector adapted to be mated with a receptacle connector.
Figure 2:
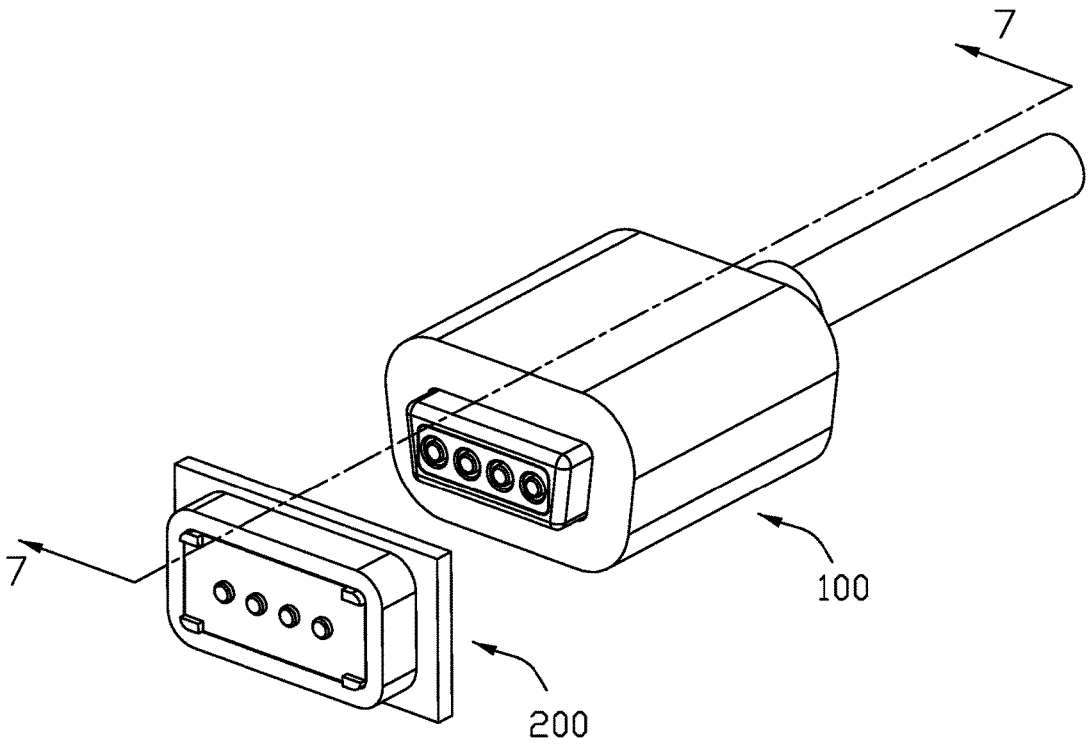
FIG. 2 is a perspective view of the plug connector is ready to be mated with a receptacle connector.
Figure 3:
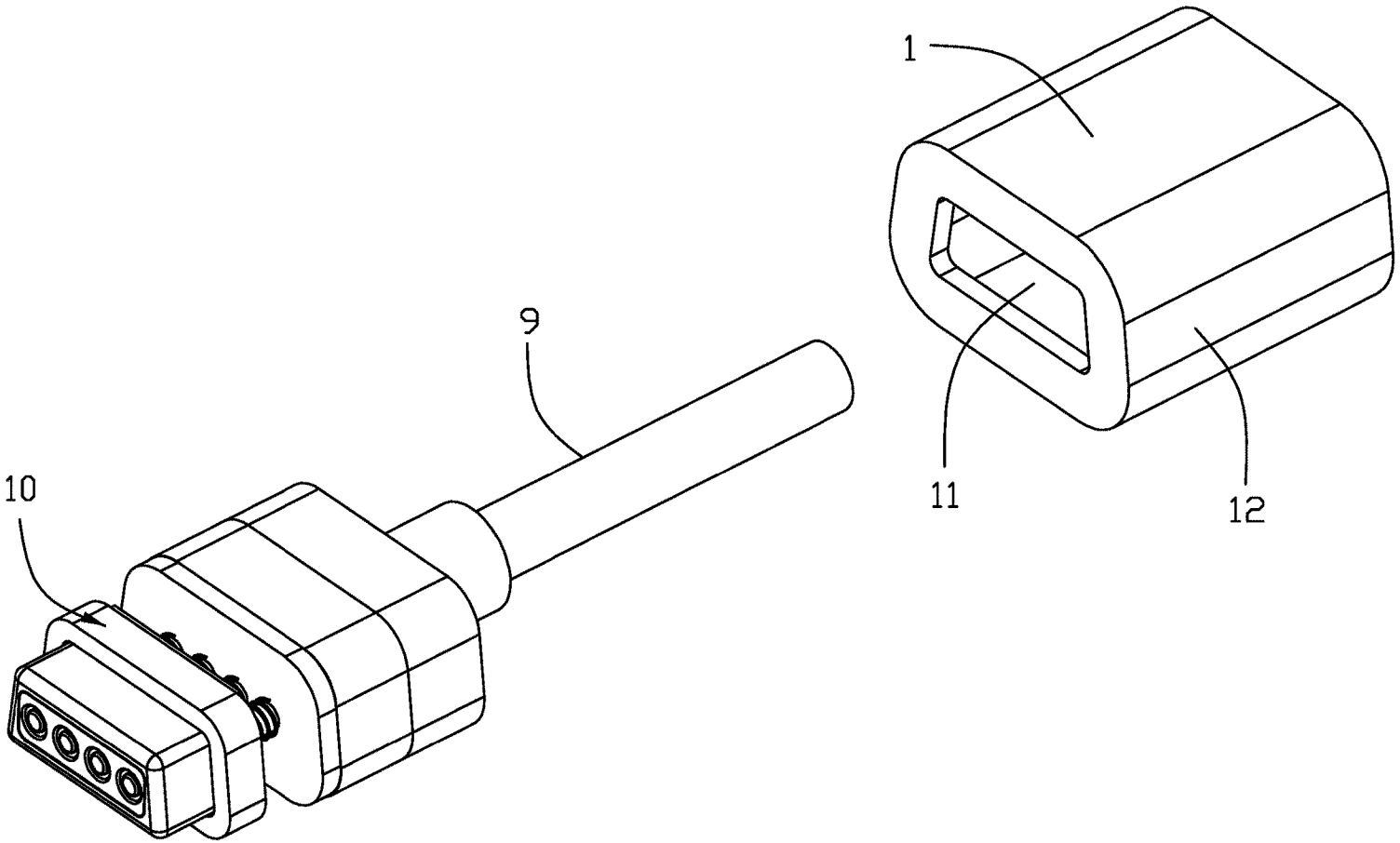
FIG. 3 is an exploded view of plug connector as show in FIG. 2.
Figure 4:
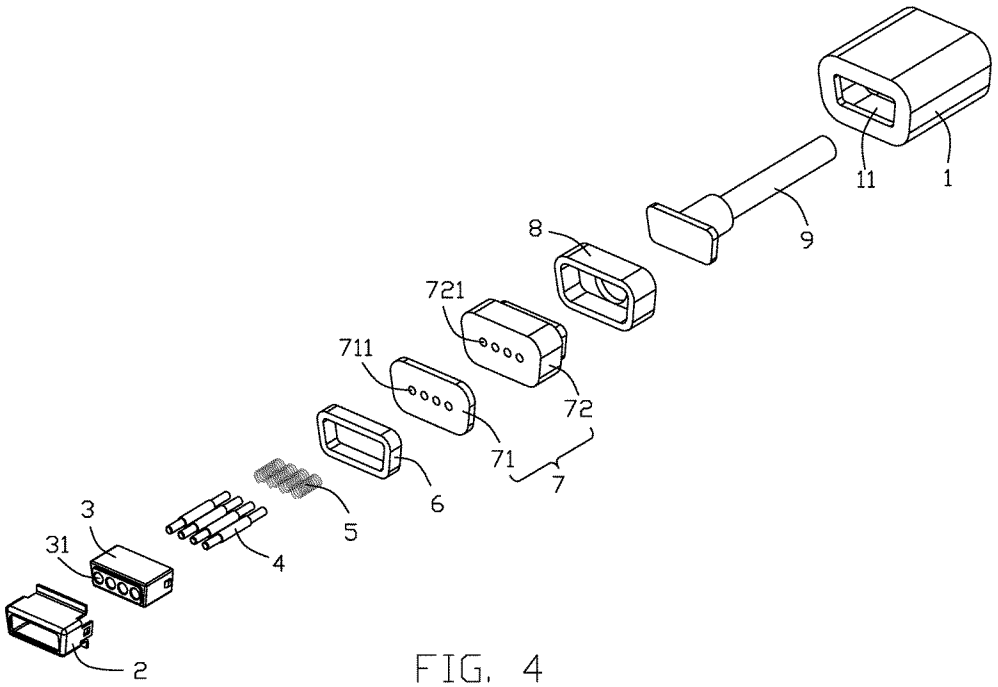
FIG. 4 is a further exploded view of plug connector as shown in FIG. 3.
Figure 5:
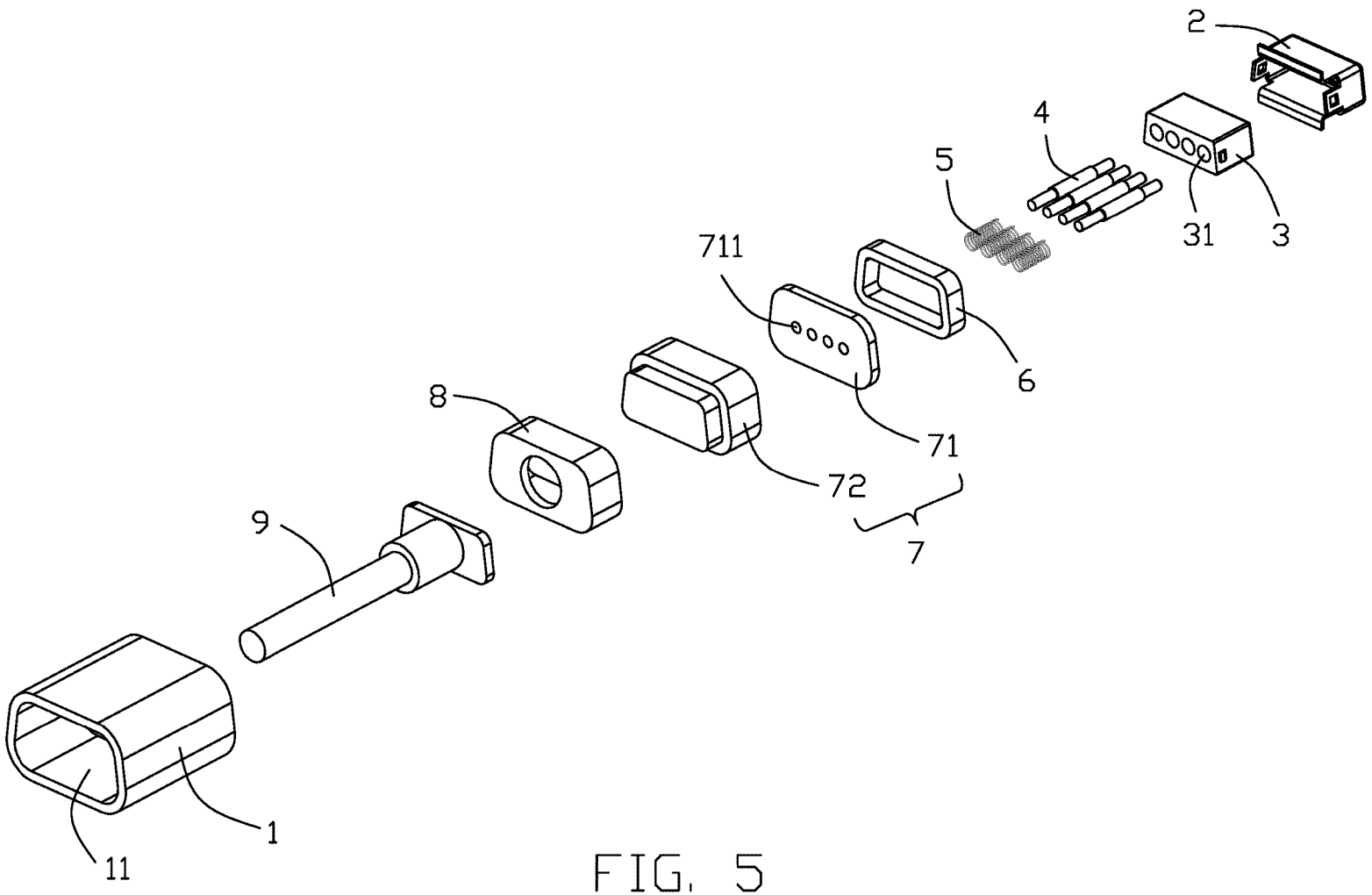
FIG. 5 is another exploded view of plug connector as shown in FIG. 4.
Figure 6:
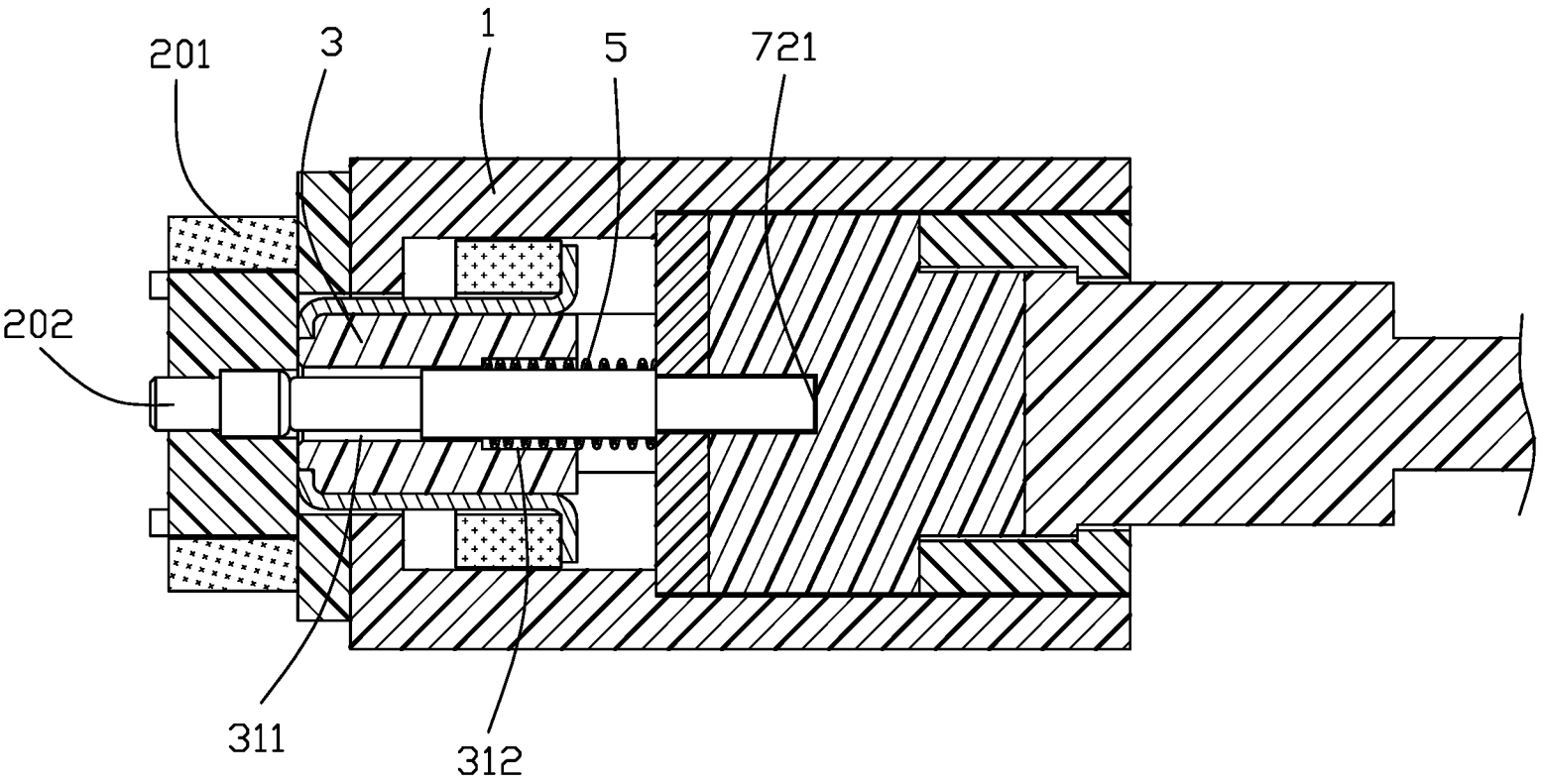
FIG. 6 is across section view of plug connector taken along line 6-6 in FIG. 1.
Figure 7:
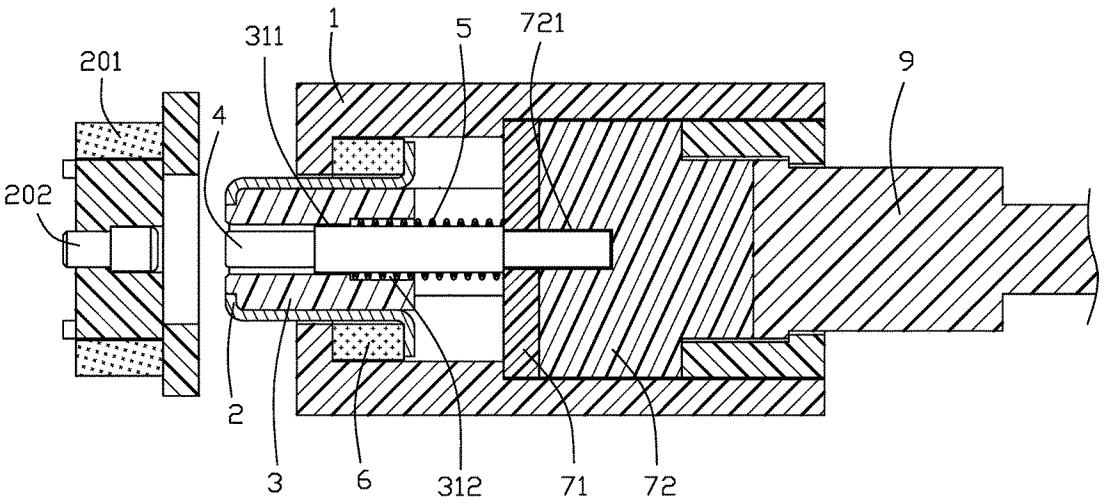
FIG. 7 is across section view of plug connector taken along line 7-7 in FIG. 2.

Referring to FIGS. 1 to 7, a plug connector 100 adapted to be matched with receptacle connector 200 by magnetic attraction. The plug connector 100 includes a cylinder sleeve 1, a terminal module 10, and a cable 9 behind the terminal module 2.

The cylinder sleeve 1 comprises a receiving cavity 11 through the cylinder sleeve 1 in front to back direction and a plurality of side walls 12 around the receiving cavity 11.

The terminal module 10 including a fixed body 7 received in the receiving cavity 11, an insulative housing 3 located in front of the fixed body 7 and extended beyond the cylinder sleeve 1, a magnetic element 6 received in the cylinder sleeve 1 and around the insulative housing 3, a metal shell 2 enclosed in the insulative housing 3, a plurality of elastic elements 5, and a plurality of movable terminals 4 arranged along the transverse direction. The fixed body 7 is used for fixing the rear end of the movable terminals 4 and includes a fixing member 71 and a module 72 assembled at rear end of the fixing member 71. The fixing member 71 includes a plurality of pinholes 711, the movable terminals 4 extending through the corresponding pinholes 711. The module 72 includes a plurality of grooves 721, and the movable terminals 4 are inserted into the grooves 721. The insulative housing 3 includes a plurality of through holes 31 extending along the front to back direction. The movable terminals 4 may penetrate the through hole 31. The through hole 31 includes a first through hole 311 and a second through hole 312 behind the first through hole 311, the diameter of the second through hole 312 being larger than the diameter of the first through hole 311. One end of the elastic elements 5 is received in the second through hole 312 and bears against the inner wall of the second through hole 312 and the first through hole 311. The magnetic element 6 is made of a magnetic material and can be attracted by corresponding socket magnetic element 201 on the receptacle connector 200 to provide the connecting force between the plug connector 100 and the receptacle connector 200. The magnetic element 6 is approximately "D" shape and sheathed on the rear end of the metal shell 2. In this embodiment, the magnetic element 6 is a magnet. One end of the movable terminals 4 is received in the corresponding through hole 31, the other end is fixed on the corresponding grooves 721 of the module 72. In this embodiment, the movable terminals 4 are pogo pins and include springs.

The elastic element 5 is sheathed on the movable terminals 4 so as to save the space of the receiving cavity 11, thereby reducing the size of the plug connector 100. One end of the elastic element 5 bears against the insulative housing 3 and the other end bears against the fixed body 7. In this embodiment, elastic elements 5 are springs. The diameter of the cross section of the elastic element 5 is larger than the diameter of the pinhole 711 of the fixing member 71.

When the plug connector 100 is in a non working condition (not mated with the receptacle connector), the movable terminals 4 are located in the through hole 31 of the insulative housing 3. When the plug connector 100 is in a working condition (mated with the receptacle connector), magnetic element 6 and socket magnetic element 201 are attracted to each other. The insulative housing 3 is moved backwards by the force of the external force to drive the elastic elements 5 to be compressed backward, and the movable terminals 4 are exposed to the outside of the insulative housing 3. The plug connector 100 and the receptacle connector 200 are mated together and the movable terminals 4 are contacted with the socket terminal 202 to complete the electrical connection.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A plug connector comprising:

a sleeve having a receiving cavity; and a terminal module including a fixed body received in the receiving cavity, an insulative housing located in front of the fixed body and extended beyond the sleeve, a magnetic element received in the sleeve, a plurality of movable terminals, and a plurality of elastic elements, the insulative housing having a plurality of through holes, one end of the movable terminal being received in a corresponding through hole, the other end of the movable terminal being fixed on the fixed body, one end of the elastic element bearing against the insulative housing, the other end of the elastic element bearing against the fixed body, the movable terminals in non-retracted state being located inwardly of the insulative housing, the insulative housing being operable to move backwards urging against the elastic elements and exposing the movable terminals in retracted state out of the insulative housing; wherein the movable terminals are sheathed in the elastic elements.

2. The plug connector as claimed in claim 1, wherein the elastic elements are springs.

3. The plug connector as claimed in claim 1, wherein the through hole includes a first through hole and a second through hole behind the first through hole, the diameter of the second through hole is larger than the diameter of the first through hole, and one end of the elastic element is received in the second through hole.

4. The plug connector as claimed in claim 1, wherein the fixed body includes a fixing member and a module assembled at a rear end of the fixing member.

5. The plug connector as claimed in claim 4, wherein the fixing member includes a plurality of pinholes, the movable terminals extending through corresponding pinholes.

6. The plug connector as claimed in claim 5, wherein the diameter of the pinhole is smaller than the diameter of the elastic element.

7. The plug connector as claimed in claim 4, wherein the module includes a plurality of grooves, and the movable terminals are inserted into corresponding grooves, respectively.

8. The plug connector as claimed in claim 1, wherein the terminal module includes a metal shell enclosing the insulative housing, and the magnetic element is mounted on a rear end of the metal shell.

9. The plug connector as claimed in claim 8, wherein the magnetic element is approximately D-shaped and sheathed on the rear end of the metal shell, and the magnetic element comprises a magnet.

* * * * *